United States Patent [19]

Corriveau

[11] 4,208,832

[45] Jun. 24, 1980

[54] CONSTRUCTIBLE ANIMAL DOLL

[76] Inventor: Renée D. Corriveau, 27570 Spring Valley, Farmington, Mich. 48024

[21] Appl. No.: 929,306

[22] Filed: Jul. 31, 1978

[51] Int. Cl.[2] ..... A63H 33/00

[52] U.S. Cl. ..... 46/22; 46/DIG. 1

[58] Field of Search ..... 46/DIG. 1, 22, 156, 46/158, 162

[56] References Cited

U.S. PATENT DOCUMENTS

| | | | |
|---|---|---|---|
| D. 214,384 | 6/1969 | Klamer et al. | 241/111 |
| D. 214,513 | 6/1969 | Klamer et al. | 112/254 |
| D. 214,514 | 6/1969 | Klamer et al. | 314/59 |
| D. 214,515 | 6/1969 | Klamer et al. | 314/50 |
| D. 214,516 | 6/1969 | Klamer et al. | 314/50 |
| D. 214,517 | 6/1969 | Klamer et al. | 145/109 |
| 1,211,590 | 1/1917 | Kennedy | 46/22 |
| 1,221,590 | 1/1917 | Kennedy | 315/134 |
| 1,731,926 | 10/1929 | Hitchcock | 46/22 |
| 3,090,155 | 5/1963 | Gordon | 46/22 |
| 3,375,604 | 4/1968 | Alonso | 46/22 |

FOREIGN PATENT DOCUMENTS

| | | | |
|---|---|---|---|
| 566160 | 9/1975 | Switzerland | 46/162 |

*Primary Examiner*—Houston S. Bell, Jr.

*Attorney, Agent, or Firm*—Harness, Dickey & Pierce

[57] ABSTRACT

A constructible animal doll comprised of a common body and head form and a plurality of dismembered body parts that are adapted to be attached to the central body and head form in various arrangements so as to create numerous different animal forms. In addition, many of the dismembered parts are designed to be used interchangeably to create different animals.

10 Claims, 6 Drawing Figures

10
12
14
16
18
20
22
24
26
28
30
32
34
36
38
40
42
44
46
48
50

CONSTRUCTIBLE ANIMAL DOLL

BACKGROUND AND SUMMARY OF THE INVENTION

The present invention relates to a toy for children and in particular to an animal doll that can be constructed to form different types of animals or "creatures" of original creation.

The animal doll of the present invention is comprised of a common body and head form and a plurality of dismembered body parts that are adapted to be attached to the central body and head form to create a variety of different animal dolls. In particular, the dismembered parts add the characterizing features to the basic body and head form which identify the particular animal created. In addition, it will be seen that many of the dismembered body parts can be used interchangeably to create different animals. Thus, the number of different animals that can be created from a given variety of dismembered part is substantially increased.

Moreover, it will be seen that the animal doll of the preferred embodiment, being constructed of a stuffed fabric material with Velcro type attachment strips, is inexpensive to manufacture, an yet is durable and safe in design. In addition, since the doll of the present invention is designed to stimulate the imagination of a child, the doll can have significant educational benefits for small children as well.

Additional advantages and features of the present invention will become apparent from a reading of the detailed description of the preferred embodiments which make reference to the following set of drawings in which:

DETAILED DESCRIPTION OF THE PREFERRED EMBODIMENT

Figures 1, 2, 3, 4, 5, 6:
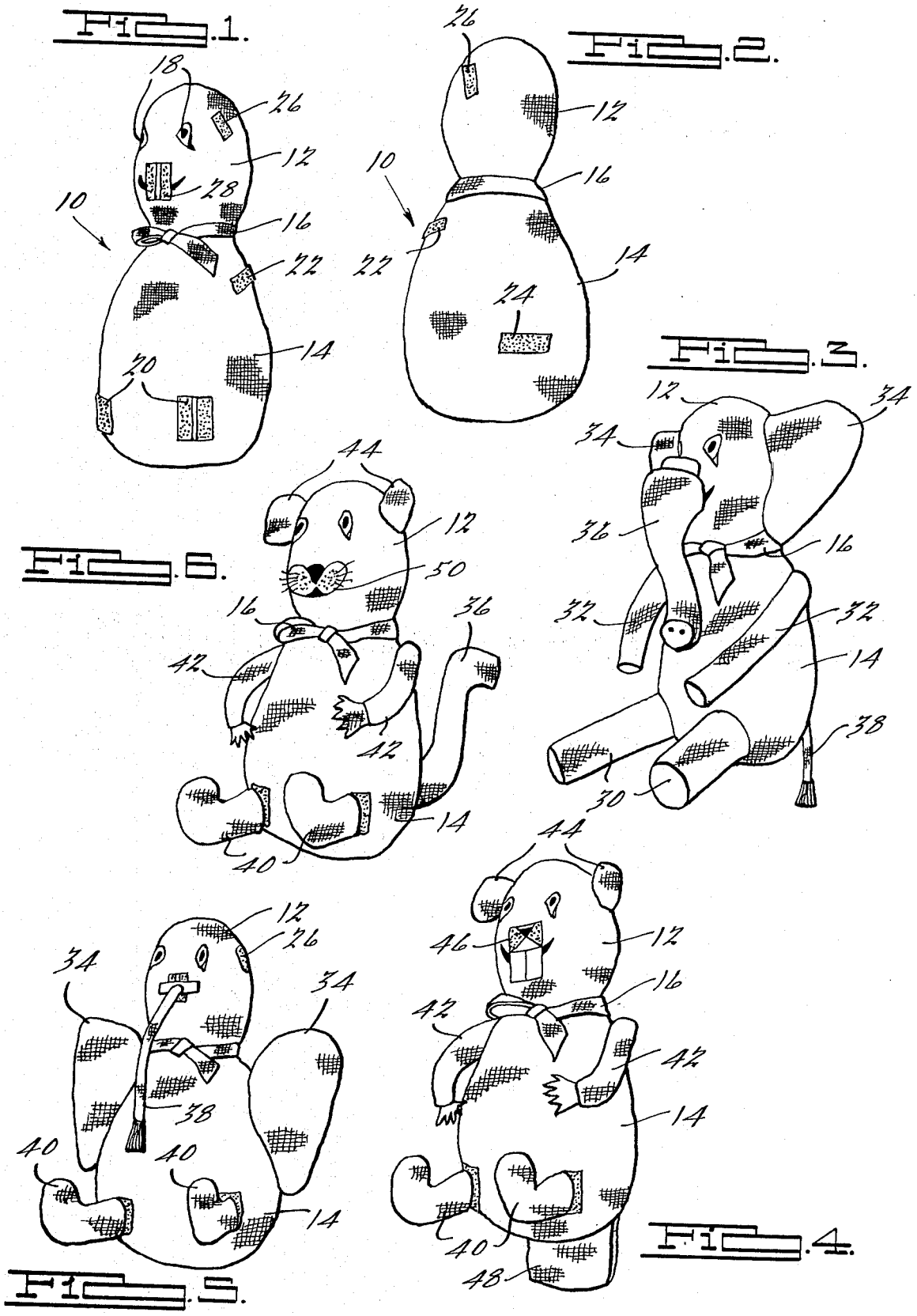
FIG. 1 is a perspective view of the central body and head form of the constructible animal doll of the present invention.
FIG. 2 is another perspective view of the central body and head form shown in FIG. 1.
FIG. 3 illustrates a first embodiment of the present invention wherein various dismembered parts are attached to the central body and head form shown in FIGS. 1 and 2 to create an elephant.
FIG. 4 is a perspective view of another embodiment of the present invention wherein various dismembered parts are attached to the central body and head form illustrated in FIGS. 1 and 2 to create a beaver.
FIG. 5 is a perspective view of another embodiment of the present invention wherein various dismembered parts from FIGS. 3 and 4 are attached to the central body and head form of FIGS. 1 and 2 in a different arrangement to create a mosquito.
FIG. 6 is an illustration of another embodiment of the present invention wherein various dismembered parts are attached to the central body and head form of FIGS. 1 and 2 to create a cat.

Referring to FIGS. 1 and 2, the preferred embodiment of the basic body 14 and head 12 form of the present invention is shown. As can be seen from the drawings, the head 12 is perferably substantially oval-shaped and the body 14 "egg-shaped" with the body 14 being approximately two to three times the size of the head 12. Optionally, a bow 16 may be tied around the neck of the doll 10 for aesthetic purposes.

The body and head form illustrated in FIGS. 1 and 2 comprises the central component from which all of the different types of animals are created. In other words, by attaching different dismembered parts to the central body and head form in the manner to be described, various types of animals or "creatures" of original creation can be made. Importantly, with the animal doll of the present invention, the identifying characteristics of the animal to be created are determined by the particular dismembered parts selected for attachment to the central body and head form, and by the arrangement in which they are attached.

In the preferred embodiment, central body and head form 10 is constructed of a stuffed fabric material which is soft, and therefore less likely to cause injury, and yet durable and rigid enough to withstand extensive use without losing its shape. The eyes 18 are either stitched or glued to the head 12 and are not intended to be removed.

Fastened to the body 14 at the legs, arms (or "wings"), and tail positions, 20, 22 and 24 respectively, and also to the head 12 at the ears and nose positions, 26 and 28 respectively, are Velcro type attachment strips. The Velcro type strips serve to provide a convenient means of removably and interchangeably connecting to the central body and head form 10 the various dismembered body parts that characterize the different animals which can be constructed. However, other types of fastening means may be employed. Each of the various dismembered parts in the preferred embodiment, accordingly, have fastened thereto complimentary Velcro type attachment strips (not shown) which readily attach to the strips on the central body and head form 10.

The various dismembered body parts in the preferred embodiment of the present invention are also constructed of a stuffed fabric material. Optionally, the fabric covering on the dismembered body parts can be color-keyed to the central body and head form 10 or to the other dismembered body parts used to construct a particular animal. For example, the legs 30, arms 32, ears 34, trunk 36 and tail 38 of the elephant illustrated in FIG. 3 may all be covered with a patterned fabric, while the legs 40, arms 42, ears 44, nose 46 and tail 48 of the beaver illustrated in FIG. 4 may be covered with a plain brown fabric. In this manner, very young childred can more readily identify the proper set of dismembered body parts for constructing a complete animal.

In addition, it will be noted that the animal doll of the present invention is designed so that many of the dismembered body parts can be used interchangeably to create different animals. For example, a "mosquito" can be created by attaching the ears 34 of the elephant to the arm pads 25 on the body 14, the tail 38 of the elephant to the nose pad 28 on the head 12, and retaining the legs 40 from the beaver, (See FIG. 5). Similarly, by replacing the tail 48 of the beaver with the trunk 36 of the elephant and attaching the appropriate nose 50, a cat is created, (See FIG. 6). Moreover, by adding a few additional dismembered body parts, it can readily be seen that the creation of numerous other animals are possible; such as a dog, a bear, or even a bull (using the legs 40 of the beaver as "horns"). Thus, it is apparent that with a little imagination, the number of different animals which can be created with the doll of the present invention is extensive.

Moreover, in addition to the construction of "actual" animal figures the doll of the present invention can be used to create creatures of "original" design as well. For example, the dismembered body parts may be attached to the central body and head form 10 so as to create animal "combinations", such as an elephant with the tail 48 of a beaver, etc. Thus, it can be seen that the total number of creations possible is limited only by the imagination of the child.

while the above description constitutes the preferred embodiments of the invention, it will be appreciated that the invention is susceptible to modification, variation and change without departing from the proper scope or fair meaning of the accompanying claims.

what is claimed is:

1. A constructible animal doll comprising a central body and head form of fixed size and shape, a plurality of dismembered body parts adapted to be attached to said central body and head form in various arrangements so as to create a plurality of different animals, at least some of said plurality of dismembered body parts being attachable at different locations on said central body and head form to serve as different parts for different animals, and attachment means for removably attaching said dismembered body parts to said central body and head form.

2. The constructible animal doll of claim 1 wherein said attachment means comprises Velcro type attachment strips.

3. The constructible animal doll of claim 1 wherein said central body and head form is constructed of a stuffed fabric material.

4. The constructible animal doll of claim 3 wherein said dismembered body parts are constructed of a stuffed fabric material.

5. The constructible animal doll of claim 4 wherein the fabric covering on the appropriate dismembered body parts for constructing a particular animal are identical in appearance.

6. The constructible animal doll of claim 1 wherein said plurality of dismembered body parts includes various legs, arms (wings), ears, noses and tails.

7. The constructible animal doll of claim 1 wherein said central body and head form comprises a substantially oval-shaped head and a substantially egg-shaped body.

8. The constructible animal doll of claim 1 wherein said plurality of dismembered body parts includes elephant ears, an elephant tail, an elephant trunk, and elephant arms and legs for creating an elephant, as well as beaver ears, arms, and legs, a beaver nose, and a beaver tail for creating a beaver, said elephant ears being attachable to said central body and head form to serve as the wings of a mosquito, said elephant tail being attachable to said central body and head form to serve as the nose of a mosquito, and said beaver legs being attachable to said central body and head form to serve as the legs of a mosquito for creating a mosquito upon attachment to said central body and head form.

9. The constructible animal doll of claim 8 wherein said plurality of dismembered body parts further includes the nose of a cat, said beaver ears, arms and legs also serve as the ears, arms and legs of a cat, and said elephant trunk is attachable to said body and head form to serve as the tail of a cat for creating a cat upon attachment to said central body and head form.

10. A constructible stuffed fabric animal doll comprising: a central body and head form of fixed size and shape, said body having affixed thereto at the legs, arms (wings), and tail positions, and said head having affixed thereto at the ears and nose positions, Velcro type attachment strips; and a plurality of dismembered body parts including various legs, arms (wings), tails, ears and noses that are adapted to be attached at appropriate locations to said central body and head form in various arrangements so as to create a plurality of different animals, each of said plurality of dismembered body parts having affixed thereto Velcro type attachment strips complimentary to the strips on said central body and head form, at least some of said plurality of dismembered body parts being attachable at different locations on said central body and head form to serve as different parts for different animals.

* * * * *